United States Patent [19]

Ikeda

[11] 4,116,403

[45] Sep. 26, 1978

[54] BOBBIN UTILIZED FOR MAKING YARN PACKAGES IN TEXTILE MACHINES

[75] Inventor: Teruo Ikeda, Kariya, Japan

[73] Assignee: Kabushiki Kaisha Toyoda Jidoshokki Seisakusho, Japan

[21] Appl. No.: 796,030

[22] Filed: May 11, 1977

[30] Foreign Application Priority Data

May 18, 1976 [JP] Japan ..... 51-62981[U]
Jun. 14, 1976 [JP] Japan ..... 51-77283[U]

[51] Int. Cl.[2] ..... B65H 55/00; B65H 75/10

[52] U.S. Cl. ..... 242/165; 242/18 PW; 242/118.3

[58] Field of Search .....242/118.3, 118.31, 118.32, 242/177, 165, 164, 118.1, 125.1, 18 PW, 18 EW, 130.1

[56] References Cited

U.S. PATENT DOCUMENTS

| | | | |
|---|---|---|---|
| 1,769,929 | 7/1930 | Lindenberg | 242/118.3 |
| 1,858,410 | 5/1932 | Morey | 242/118.32 |
| 1,915,200 | 6/1933 | Parks | 242/165 |
| 3,746,275 | 7/1973 | Whisnant | 242/118.32 |

*Primary Examiner*—George F. Mautz
*Attorney, Agent, or Firm*—Burgess, Ryan and Wayne

[57] ABSTRACT

Disclosed is a cone bobbin utilized for making a yarn package thereon. The bobbin is provided with a main portion having a shape of a frustum of a cone, whereon the yarn package can be formed. From the bottom end of the main portion, a cylindrical bottom end portion of the bobbin is coaxially extended toward the outside, and a reserve winding can be formed on this bottom end portion.

1 Claim, 4 Drawing Figures

BOBBIN UTILIZED FOR MAKING YARN PACKAGES IN TEXTILE MACHINES

SUMMARY OF THE INVENTION

The present invention relates to a bobbin utilized for making yarn packages in textile machines such as a winding or rewinding machine or a twisting machine.

In textile factories, when rewound yarn packages are produced by each unit of a winding machine by a plurality of yarn packages, such as parallel cheeses or cone cheeses, it is quite common to use a plurality of yarn packages in such a way that an end of a wound yarn of a second yarn package is connected to a reverse winding of a first yarn package from which a material yarn is being supplied to produce a rewound yarn package, and an end of a wound yarn of a third yarn package is connected to a reserve winding of the second yarn package, an end of a wound yarn of a fourth yarn package is connected to a reverse winding of the third yarn package, and so on. Therefore, the yarns of these yarn packages are connected so as to form a continuous yarn. The above-mentioned reserve winding is formed at a bottom portion of a bobbin whereon the main portion of the yarn package is formed. When the above-mentioned connection between two yarn packages is formed, it is usual to take off the reserve winding from the bobbin by manually displacing the reserve winding along the longitudinal axis thereof toward the bobbin end.

In a case of utilizing cone cheeses as the material yarn packages, the cone cheese is formed on a cone bobbin. The above-mentioned reserve winding is formed on the bottom portion of the cone bobbin where the cross-sectional diameter thereof gradually increases along the longitudinal axis thereof toward the bottom end. Therefore, when the reserve winding is removed from the bottom portion of the cone bobbin, since the cross-sectional diameter of the bobbin is gradually increased toward the bobbin end, it is necessary to provide a strong force to remove the reserve winding from the bottom portion of the bobbin. If a yarn of small extendability, such as a cotton yarn, is used as a material yarn, the above-mentioned manual operation for removing the reserve winding from the cone bobbin is a very troublesome job so that the overall working efficiency is remarkably lowered. Such problem is particularly realized in the case of utilizing the cone bobbin having a larger taper.

The purpose of the present invention is to provide a cone bobbin having a particularly shaped bottom portion which solves the above-mentioned problem.

To attain the purpose of the present invention, the cone bobbin according to the present invention is provided with a bottom portion having a cylindrical shape and the remaining portion thereof having a conical shape so that the cross-sectional diameter thereof is gradually decreased toward the tip end of the bobbin.

DETAILED EXPLANATION OF THE INVENTION

Figure 1:
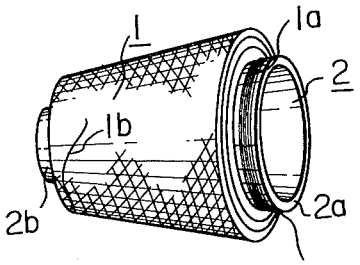
FIG. 1 is a schematic side view of a cone cheese formed on a conventional cone bobbin.
Figure 2:
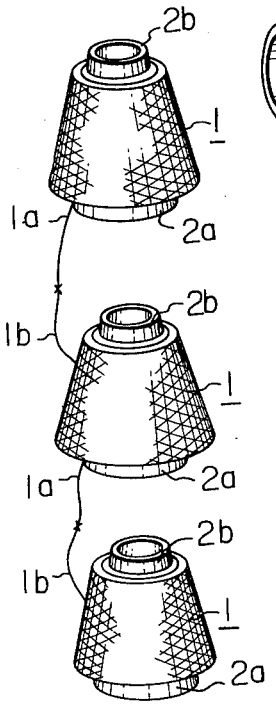
FIG. 2 is a front view of a plurality of cone cheeses of the type shown in FIG. 1, in a condition where each two adjacent cone cheeses are connected.

For the sake of a better understanding of the characteristic feature of the present invention, the problem related to the utilization of the conventional cone bobbin, which was previously discussed, is hereinafter explained again with reference to FIGS. 1 and 2. The yarn package 1 is formed on a conventional cone bobbin 2 provided with a cone shaped surface. In this yarn package 1, a reserve winding 1*a* composed of a plurality of windings is formed on a bottom portion 2*a* of the cone bobbin 2 and an end 1*b* of the wound yarn is placed on the most outside layer of the yarn package 1. When it is required to connect the yarn of three adjacent yarn packages 1 of a group of yarn packages, the reserve winding 1*a* of a first yarn package 1 is connected to the end 1*b* of the wound yarn of a second yarn package 1, while the reserve winding 1*a* of the second yarn package 1 is connected to the end 1*b* of the wound yarn of a third yarn package 1. Therefore, when the yarns of three adjacent yarn packages 1 are connected as shown in FIG. 2, it is necessary to displace the reserve winding 2*a* of each yarn package 1 toward the end of its cone bobbin 2 having the largest cross-sectional diameter. Since the windings of the reserve winding 1*a* are tightly formed on the bottom end portion 2*a* of the cone bobbin 2, it is very difficult to smoothly remove the reserve winding 1*a* from the cone bobbin 2.

Figure 3:
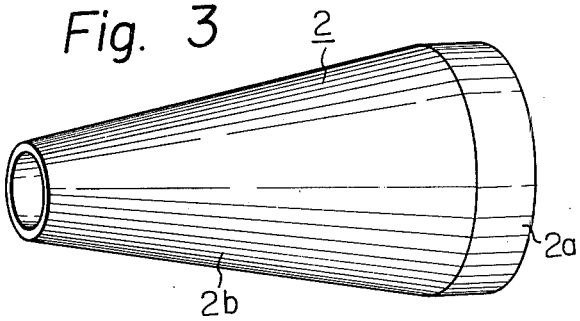
FIG. 3 is a schematic side view of a cone bobbin according to the present invention.

The cone bobbin 2 according to the present invention, shown in FIG. 3, is composed of a main portion 2*b* having a shape of a frustum of a cone, wherein the cross-sectional diameter thereof is gradually decreased along the lengthwise direction toward the tip end thereof, and a cylindrical bottom portion 2*a*. The main portion 2*b* is a portion whereon the yarn layers of the cone cheese is formed, while the reserve winding is formed on the cylindrical bottom portion 2*a* of the bobbin 2. Therefore, when it is required to remove the reserve winding from the bottom portion 2*a* of the bobbin 2, since the cross-sectional diameter of the bobbin 2 is not changed in this bottom portion 2*a*, the reserve winding can be easily displaced toward the end of the bottom portion 2*a*. As a result, the above-mentioned problem observed in the utilization of the conventional cone cheese can be completely eliminated.

In addition to the above-mentioned advantage of the cone bobbin according to the present invention, the following advantage can be expected. That is, in the case of utilizing a conventional cone bobbin, when the reserve winding 1*a* is formed on the bobbin 2, the bottom end portion 2*a* of the bobbin 2 frictionally contacts a driving roller of a winding mechanism (not shown). Therefore, the bottom end portion 2*a* works to transmit the driving force from the driving roller to the bobbin 2. When the yarn is introduced into the range of the transverse guide motion of the winding mechanism, the contact point of the bobbin with the driving roller is changed to the position in the range of the transverse guide motion and, therefore, the tension of the winding yarn varies during the initial stage of forming the yarn package 1. However, in the case of utilizing the cone bobbin 2 according to the present invention, since the main portion 2*b* of the bobbin contact the driving roller, while the bottom end portion 2*a* of the bobbin 2 does not contact the driving roller, the above-mentioned possible variation of the yarn tension during the yarn package forming operation on the cone bobbin can be completely avoided so that a cone cheese having an excellent cone shape can be produced.

Figure 4:
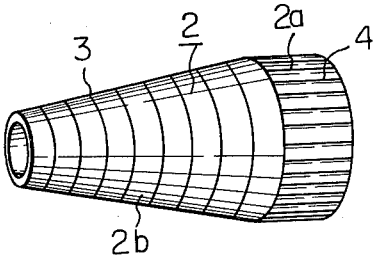
FIG. 4 is a schematic side view of a modified cone bobbin according to the present invention.

In the embodiment shown in FIG. 4, a plurality of ring shaped grooves 3 are formed on the cone surface of the main portion 2*b* of the bobbin 2, and a plurality of grooves 4 are formed on the cylindrical surface of the end portion 2*a* in parallel condition to the longitudinal axis of the cone bobbin 2. The ring shaped grooves 3 have been also applied to the conventional cone bobbin so as to prevent the possible displacement of a bottom yarn layer in the longitudinal direction of the bobbin. However, it must be noted that, in the conventional cone bobbin, the above-mentioned ring shaped grooves are also formed on the surface of the bottom end portion of the bobbin and, therefore, the abovementioned problem observed when the reserve winding is removed from the bobbin is aggravated. However, in this embodiment, the grooves 4 do not interfere with the removing motion of the reserved winding 1*a* from the bobbin 2 but, rather, allow a smoother removal the reserve winding 1*a* from the bobbin 2 compared with the first embodiment shown in FIG. 3.

What is claimed is:

1. A yarn package comprising a bobbin having a major frustoconical portion and a minor smooth cylindrical portion extending from and coextensive with the large diameter end of said frustoconical portion, a conical yarn cheese wound only on said frustoconical portion of said bobbin, and a reserve yarn winding extending from the large diameter end of said cheese and wound only on said smooth cylindrical portion of said bobbin, whereby said reserve winding may be readily removed from said bobbin without substantially increasing the tension thereof.

* * * * *

UNITED STATES PATENT OFFICE

CERTIFICATE OF CORRECTION

Patent No. 4,116,403 Dated September 26, 1978

Inventor(s) Teruo Ikeda

It is certified that error appears in the above-identified patent and that said Letters Patent are hereby corrected as shown below:

Column 4, line 2 : after "removal" insert --of--

Signed and Sealed this

*Tenth* Day of *April 1979*

[SEAL]

*Attest:*

RUTH C. MASON
*Attesting Officer*

DONALD W. BANNER
*Commissioner of Patents and Trademarks*